US009499326B2

(12) United States Patent
Choy et al.

(10) Patent No.: US 9,499,326 B2
(45) **Date of Patent: *Nov. 22, 2016**

(54) VACUUM ACTIVATED SHIPPING CONTAINER

(76) Inventors: Anthony Choy, San Francisco, CA (US); Jun Araya, Toyama (JP); Dennis Chek Kong Chan, Menlo Park, CA (US)

( * ) Notice: Subject to any disclaimer, the term of this patent is extended or adjusted under 35 U.S.C. 154(b) by 940 days.

This patent is subject to a terminal disclaimer.

(21) Appl. No.: 13/291,021

(22) Filed: Nov. 7, 2011

(65) Prior Publication Data

US 2012/0048770 A1 Mar. 1, 2012

Related U.S. Application Data

(63) Continuation of application No. 12/047,522, filed on Mar. 13, 2008, now Pat. No. 8,069,987.

(51) Int. Cl.
*B65D 73/00* (2006.01)
*B65D 81/20* (2006.01)
*B65D 77/04* (2006.01)

(52) U.S. Cl.
CPC ..... *B65D 81/2015* (2013.01); *B65D 77/0446* (2013.01); *B65D 77/0486* (2013.01); *B65D 81/2023* (2013.01)

(58) Field of Classification Search
USPC ..... 206/524.1
See application file for complete search history.

(56) References Cited

U.S. PATENT DOCUMENTS

| | | | | |
|---|---|---|---|---|
| 4,240,556 | A * | 12/1980 | Field | 206/522 |
| 4,262,801 | A * | 4/1981 | Avery | 206/522 |
| 5,246,114 | A * | 9/1993 | Underwood | 206/524.8 |
| 6,220,051 | B1 * | 4/2001 | Takasugi | 62/530 |
| 6,220,473 | B1 * | 4/2001 | Lehman et al. | 220/592.27 |
| 7,066,347 | B2 * | 6/2006 | Slovak et al. | 220/754 |
| 7,147,125 | B1 * | 12/2006 | Slovak et al. | 220/592.2 |
| 7,784,301 | B2 * | 8/2010 | Sasaki et al. | 62/457.2 |
| 8,011,171 | B2 * | 9/2011 | Repkin et al. | 53/432 |
| 8,069,987 | B2 * | 12/2011 | Choy et al. | 206/524.8 |
| 8,317,046 | B2 * | 11/2012 | Vanderberg et al. | 220/6 |
| 8,333,279 | B2 * | 12/2012 | Veiseh | 206/524.8 |
| 2008/0223862 | A1 * | 9/2008 | Vanderberg et al. | 220/592.03 |
| 2008/0272146 | A1 * | 11/2008 | Kaczmarek | 222/105 |
| 2009/0032429 | A1 * | 2/2009 | Morris et al. | 206/522 |
| 2011/0168764 | A1 * | 7/2011 | Kasiwabara | 229/87.02 |

* cited by examiner

*Primary Examiner* — Jacob K Ackun
(74) *Attorney, Agent, or Firm* — Bay Area Technology Law Group PC

(57) ABSTRACT

A shipping container having side walls, a bottom and a top defining an internal volume. The top is selectively displaceable for gaining access to the internal volume and for sealing the internal volume of the container. A valve drawing a vacuum on the internal volume from outside of the container is provided. The side walls are capable of contracting and expanding as a result of the pressure within the internal volume.

11 Claims, 4 Drawing Sheets

VACUUM ACTIVATED SHIPPING CONTAINER

RELATED APPLICATION DATA

The present application is a continuation of U.S. Application Ser. No. 12/047,522, filed on Mar. 13, 2008, currently pending.

TECHNICAL FIELD

The present invention involves a shipping container capable of containing a variety of product sizes and shapes. The container is designed to ship products requiring thermal insulation in order to maintain product integrity throughout the shipping process. The shipping container is capable of being reduced in volume under certain vacuum conditions imposed within the container.

BACKGROUND OF THE INVENTION

There are a wide variety of containers used for shipping products over conventional channels. Whether shipping is done by air, cargo vessel, rail or truck, all shipping containers must exhibit certain basic characteristics depending upon the product being transported. The present invention deals specifically with containers which are useful in shipping products which are perishable or otherwise require maintaining a somewhat consistent temperature independent of ambient conditions. Most often, containers include cold packs or, in some instances, hot packs and insulative side walls which help to maintain stable temperatures throughout the shipping process. The use of a vacuum to minimize heat transfer is well known. For decades, vacuum bottles have been used having an internal volume and evacuated side walls to reduce thermal transfer.

More recently, it has been discussed in the literature that heat transfer can be reduced if the internal volume of a shipping container, as opposed to its side walls, is subjected to vacuum.

Specifically, U.S. Pat. No. 5,918,478 is directed to an insulated chest for storage of items at elevated or reduced temperature which has enhanced insulation, and a cover sealed tight by use of vacuum. The separate cover, four sidewalls, and bottom are formed with dual wall construction (relatively heavy plastic with insulation in-between). When the chest is manufactured, the sidewalls and bottom are internally evacuated and sealed to enhance their insulative qualities. After items are placed in the container with charged heating or cooling elements as needed, the hinged cover is closed and a vacuum pump is attached to a valve conduit that passes through the cover so as to draw a vacuum in the container. The vacuum seals the cover onto the chest and enhances the thermal security of the contents. A wrench is inserted into a channel in the cover to turn a valve to a closed positioned so the vacuum pump may be removed with the vacuum maintained in the chest for storage and transportation.

U.S. Publication No. 2007/0264485 is directed to several embodiments of enclosures using aerogel insulative blankets for holding a host of different materials. The volume and shape of the enclosure may be determined based on the aerogel material or the internal surface of non-aerogel material. The aerogel material may be an organic, inorganic, or a hybrid of organic/inorganic materials. In one embodiment, insulated strips and labels suitable for insulating beverage containers may be formed, with the insulative quality augmented through the use of vacuum during manufacture of the labels. According to the publication, a rough vacuum in a sealed label of approximately 100 TORR would result in a decrease in thermal conductivity by nearly a factor of 2.

U.S. Pat. No. 5,325,281 is directed to an insulated shipping container that uses vacuum insulated panels and expanded polystyrene panels. The container illustrated as a rectangular parallelepiped, is itself formed of four containers that fit snuggly within one another and are easily removed from the assembly to be replaced if damaged. The outer closeable container is formed of corrugated cardboard. Inside this outer container is the first insulating housing that is formed of expanded polystyrene. Within the polystyrene housing is the second insulating housing formed of vacuum insulated panels. Inside this vacuum insulated panel housing is an inner closed container of corrugated cardboard.

U.S. Publication No. 2007/0095712 is directed to a shipping container for transporting biologically hazardous materials safely, even at high altitudes. The outer box of the container is intended to be rigid and gas permeable (constructed for example from corrugated cardboard). The outer box includes an inner box constructed of expanded polystyrene foam insulation such as Styrofoam. The interior enclosure is a flexible bag preferably made of polyethylene plastic that is sized so as to be capable of engaging the interior of the exterior enclosure. When biologically hazardous materials are placed within the interior of the bag, the bag is then at least partially evacuated. The bag preferably includes lines providing visual indications to guide its evacuation and seal.

U.S. Publication No. 2007/0157564 is directed to a vacuum package system for transporting a plurality of medical containers. The packaging system 10 includes a tray 14 that holds a plurality of medical containers 16, such as vials. When the containers are disposed in the tray and prepared for shipment, the tray is inserted into an air impervious vacuum bag. A vacuum is applied to the vacuum bag. When fully evacuated, the bag is sealed to embrace the vials and holds them from moving.

There are certain limitations inherent in the use of prior shipping containers which have been recognized and addressed in the present disclosure.

Recognizing that many products sold in this country are manufactured off shore, shipping volumes become of paramount economic interest. Manufacturers in, for example, Asia, attempt to house as many packages as possible within containers loaded on containerized vessels for transoceanic shipment. Sophisticated shipping containers such as those contemplated herein and in the prior art are provided with valves and insulated walls which occupy shipping volumes which, if reduced, could greatly improve the economies of containerized shipment. As such, it is one object of the present invention to provide a container which can be reduced in volume to the extent practical for maintaining the integrity of the product residing within its internal volume.

Yet another issue unaddressed by the prior art involves dealing with changes in internal pressure which inherently occur over time. For example, if dry ice was used as a coolant, the dry ice would sublimate and increase the pressure of the container. Under certain circumstances, a change in pressure could be dealt with by installing a valve through the side wall of the container but, in some instances, that is not a practical solution. Thus, it is yet another object of the present invention to provide a shipping container which can deal effectively with changes in container pressure whether or not a valve is employed.

SUMMARY OF THE INVENTION

A shipping container having side walls, a bottom and a top defining an internal volume. The top is selectively displaceable for gaining access to the internal volume and for sealing the internal volume of the container. A valve drawing a vacuum on the internal volume from outside of the container is provided. The side walls are capable of contracting and expanding as a result of the pressure within the internal volume.

DETAILED DESCRIPTION OF THE INVENTION

Figure 1:
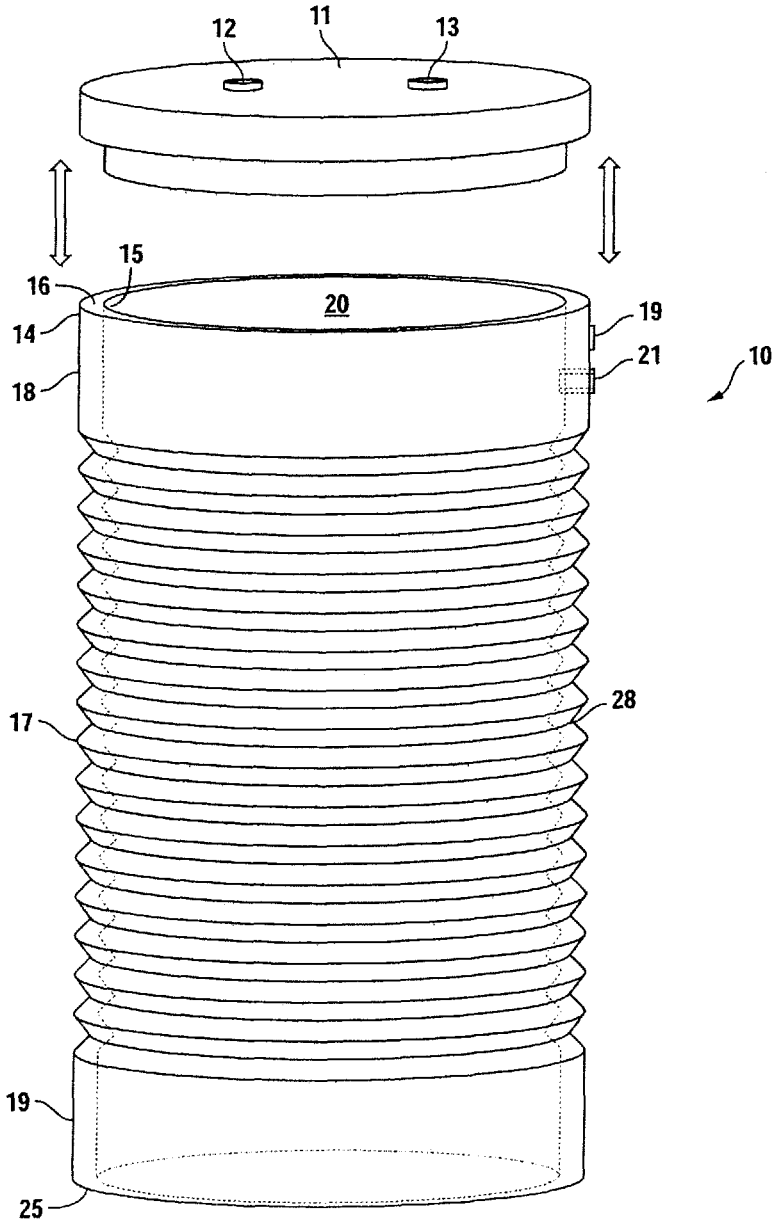
FIG. 1 is a perspective view of a shipping container of the present invention opened and within the imposition of a vacuum.
Figure 2:
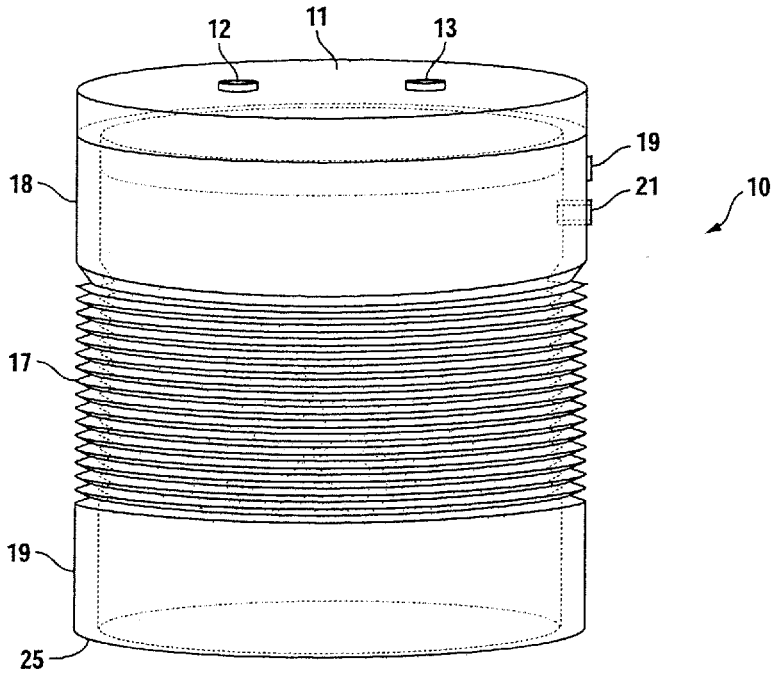
FIG. 2 is a perspective view of a shipping container of FIG. 1 once a vacuum has been imposed on its internal volume.

Turning first to FIG. 1, shipping container 10 is shown comprising side walls having, as a preferred embodiment, inner side wall 15 and outer side wall 14 creating space 16 therebetween, the purpose of which will be discussed hereinafter. The shipping container also includes bottom 25 and top 11, the latter being displaceable to gain access to internal volume 20.

Figure 3:
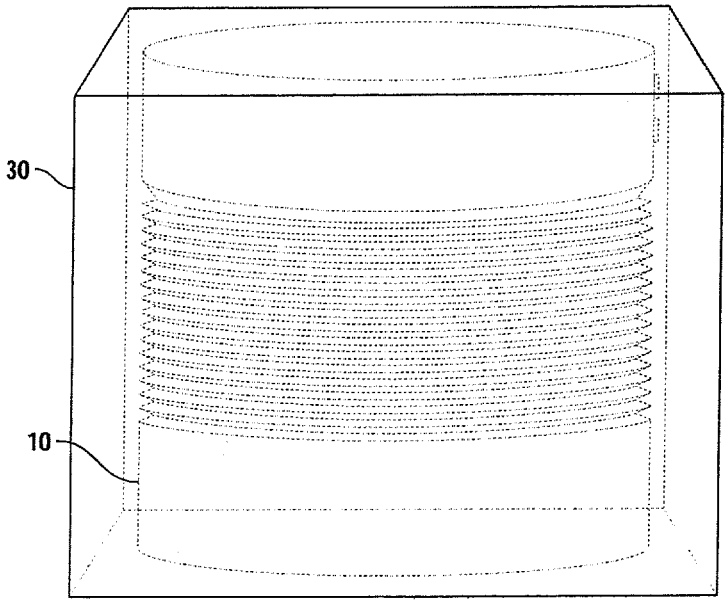
FIG. 3 is the shipping container of the present invention placed within an outer protective shipping box.

In operation, one would place the shipping contents within internal volume 20 together with, ideally, a cooling source such as ice, dry ice or a gel pack. Internal volume 20 would then be sealed by placing lid 11 on the side walls as shown. A vacuum would then be drawn through valve 12. The extent of the vacuum in conjunction with the flexibility of side walls 14 and 15 will determine the extent to which shipping container 10 collapses in volume. Once collapsed, shipping container 10 could simply be shipped as any other shipping container or placed within outer container 30 (FIG. 3) to enhance resistance to damage by external sources such as forklifts, hooks and sharp edges.

Once shipping container 10 reaches its ultimate destination and the recipient wishes to gain access to internal volume 20, air or any other gas can be introduced to internal volume 20 through valve 13. Once the vacuum is reduced or completely eliminated and internal volume 20 reaches ambient pressure, lid 11 can be easily removed. The present invention has further benefits from those described previously. For example, if the temperature rises in internal volume 20 because, for example, a cooling source becomes exhausted, pressure would build therein. Pressure could also increase if a sublimating solid such as dry ice was used as the cooling source. Not only could increased pressures be vented through optional valve 21, but expanding side wall 17 having folds 28 could expand thus relieving pressure and maintaining a somewhat vacuum induced condition within internal volume 20.

Further, in knowing the extent of gross shipping volume attributable to a shipment constituting the present invention, one could draw a vacuum through valve 12 to the extent necessary to reduce the external dimension of shipping container 10 until the appropriate dimension is reached. The only practical limitation would involve maintaining sufficient internal volume 20 to allow for receiving the product being shipped and an optional temperature maintaining source.

As a further embodiment, it also may be useful to include a heat source within internal volume 20 rather than a cold source if the product being shipped so necessitates. By providing side walls 17 that are collapsible, as the heat source dissipates, temperatures would drop within internal volume 20 and side walls 17 would accommodate reduced pressure by collapsing.

As noted previously, the exact extent of volume reduction in using shipping container 10 depends not only upon the relative pressure established within internal volume 20 vis-à-vis ambient pressure, but the resistance of side walls 17 to collapse. This latter variable can be significantly controlled by judicious choice of side wall materials, thicknesses, the extent of folds 28 and what, if anything, exists within space 16 between inner wall 15 and outer wall 14. For the sake of product integrity, it is generally suggested that portion 18 of side walls 17 near top 11 be made without the present accordion feature as well as portion 19 located proximate bottom 25. Thus the interface between lid 11 and side wall portion 18 will remain intact as will the footprint established by bottom 25.

As is commonly done, a vacuum could be established between inner side wall 15 and outer side wall 14 within space 16 by providing valve 19 accessible to a vacuum source. Space 16 could also, as a preferred embodiment, be charged with a fire retardant solid, liquid or gas to provide an additional safety feature in using the present invention. Space 16 could also be charged with an insulator, such as Styrofoam.

Figure 4:
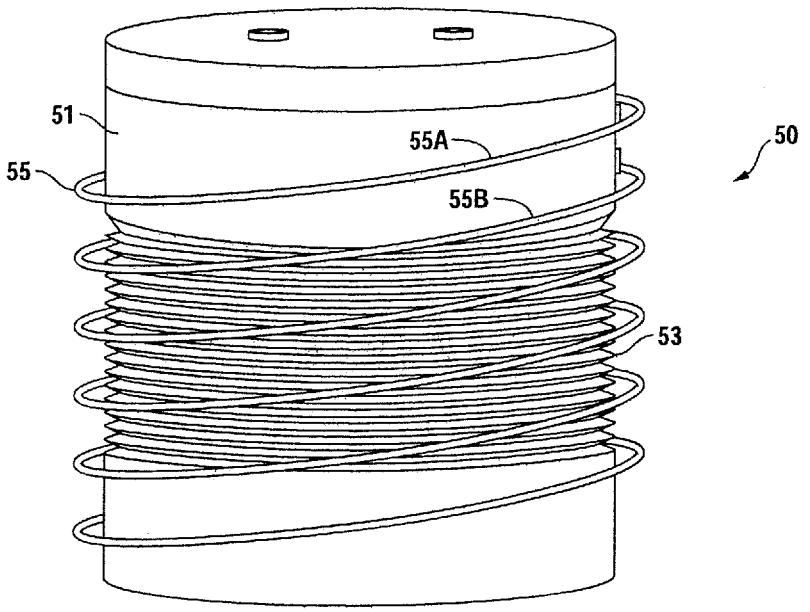
FIG. 4 is a perspective view of a shipping container of the present invention further including a support frame.
Figure 5:
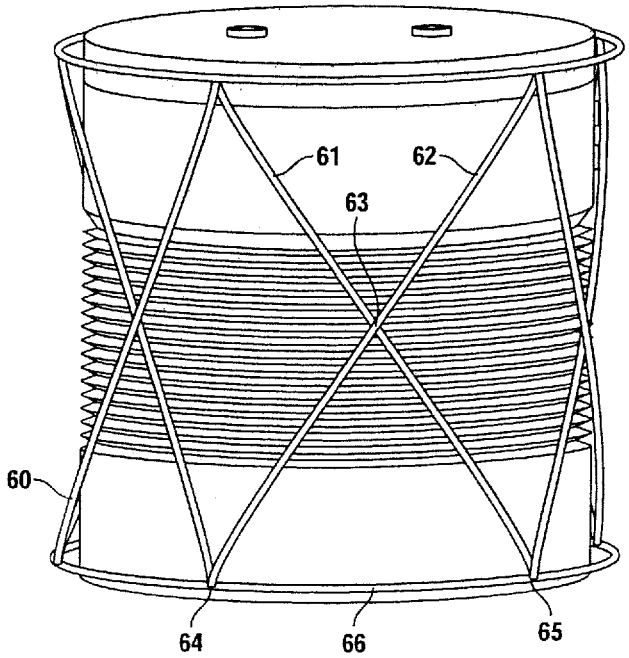
FIG. 5 is a perspective view of an alternative support frame to that shown in FIG. 4.

As yet a further embodiment, reference is made to FIG. 4. In this embodiment, support frame 55 is shown wrapped about the outside of side walls 51 to add additional structural support to shipping container 50 and to optionally urge side walls 55 into an orientation desired by the user. For example, frame 55 can be biased to resist contraction of side walls 51 by applying frame 55 to the side walls in a compressed orientation whereby the various coils 55*a*, 55*b*, etc., urge expansion and thus resist contraction along folds 53. Conversely, structural member 55 can be applied to side walls 51 in an expanded orientation where loops 55*a*, 55*b*, etc., tend to move closer together when not urged apart by side walls 51.

Although shown on the outside of side walls 51, structural member 55 can be placed on or proximate to the inner side walls of shipping container 50 or between inner and outer side walls in a space akin to space 16 (FIG. 1).

An alternative to structural member 55 is shown in FIG. 6. In this instance, loops 55, 55*b*, etc., have been replaced with scissoring members 61, 62, etc., at pivot pin 63 enabling ends 64 and 65 to slide along lower rail 66. The embodiment of FIG. 6 would enable one to lock element 61, 62, etc., in place at end points 64 and 65 to fix the appropriate shipping container at a preselected height. This would enable one to reduce the shipping container volume, fix the side wall height using structural member 60 and even if pressure increases within the internal volume of the shipping container urging the side walls to expand, structural member 60 would resist such expansion. This could be helpful in instances where the external dimension of the shipping container is the most important feature characteristic of use.

Figure 6A:
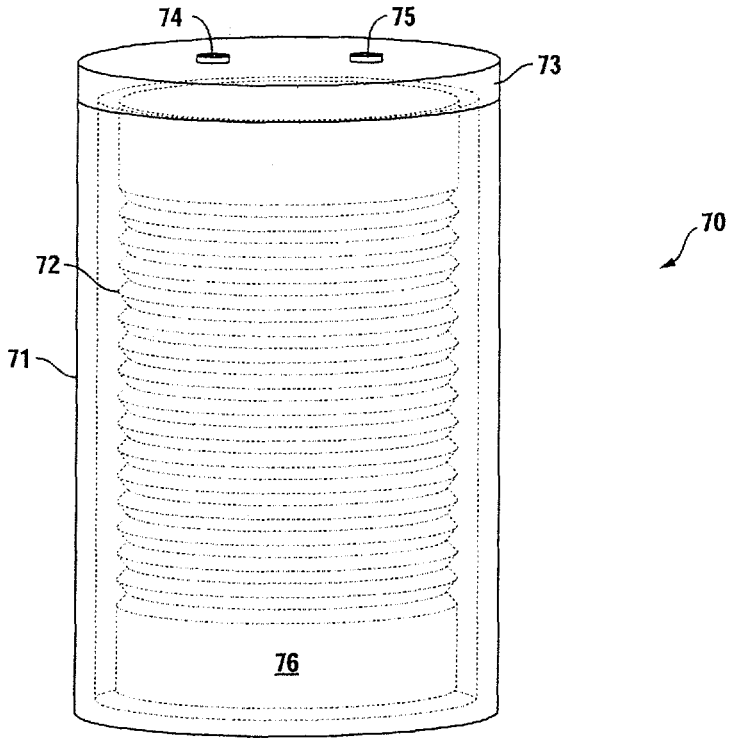
FIGS. 6A and 6B are perspective views of an additional embodiment of the present invention.
Figure 6B:
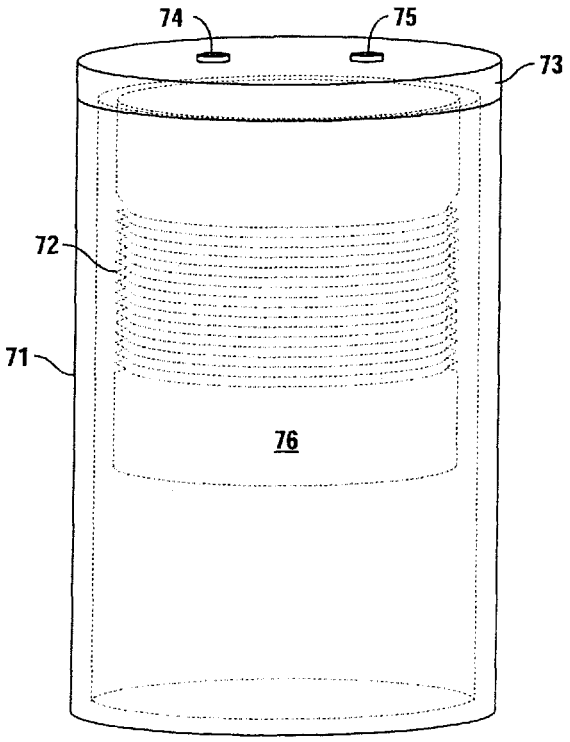

Reference is next made to FIGS. 6A and 6B illustrating another embodiment of the present invention. In this embodiment, shipping container 70 is illustrated comprised of outer wall 71 which is rigid and incapable of responding to pressure changes and inner side wall 72 having collapsing in a manner as disclosed with regard to previous embodiments. A vacuum can be drawn on valve 74 through lid 73 causing inner side walls 72 to be drawn towards lid 73 resulting in a reduction in internal volume 76 as depicted in FIG. 6B. Vacuum can be released through valve 75 to return the FIG. 6B configuration to that shown in FIG. 6A. Such an embodiment will not reduce the external volume of shipping container 70 but will enable one to draw a vacuum within space 76 for the purpose of reducing thermal transfer between space 76 and ambient.

What is claimed is:

1. A shipping container comprising side walls, a bottom and a top defining an internal volume, said top being selectably displaceable for gaining access to the internal volume and for sealing the internal volume, a valve for drawing a vacuum on said internal volume from outside of said container, said side walls being capable of contracting and expanding in relation to pressure differences between said internal volume and ambient, wherein said side walls comprise an inner wall proximate said internal volume and an outer wall spaced from said inner wall for defining the external volume of said shipping container.

2. The shipping container of claim 1 wherein said side walls are thermally insulating.

3. The shipping container of claim 1 wherein a vacuum is established and maintained between said inner and outer walls.

4. The shipping container of claim 1 wherein an insulator is positioned between said inner and outer walls.

5. The shipping container of claim 1 wherein a temperature reducing source is positioned within said internal volume.

6. The shipping container of claim 5 wherein said temperature reducing source comprises a member selected form the group consisting of ice, dry ice and gel packs.

7. The shipping container of claim 1 further comprising a pressure relief valve for selectively venting from or relieving pressure of said internal volume.

8. The shipping container of claim 1 wherein a temperature increasing source is positioned within said internal volume.

9. The shipping container of claim 1 further comprising a second container sized to receive said shipped container.

10. The shipping container of claim 1 wherein said top is removable from said side walls.

11. The shipping container of claim 1 wherein said side walls are configured to expand and contract in response to changes in temperature within said internal volume.

* * * * *